US011454043B2

(12) United States Patent
Bucarizza

(10) Patent No.: US 11,454,043 B2
(45) Date of Patent: Sep. 27, 2022

(54) FENCE PANEL

(71) Applicant: COCHRANE USA, INC., Washington, DC (US)

(72) Inventor: Vlado Bucarizza, Dubai (AE)

(73) Assignee: COCHRANE USA, INC., Washington, DC (US)

( * ) Notice: Subject to any disclaimer, the term of this patent is extended or adjusted under 35 U.S.C. 154(b) by 161 days.

(21) Appl. No.: 16/807,409

(22) Filed: Mar. 3, 2020

(65) Prior Publication Data

US 2020/0291672 A1 Sep. 17, 2020

(30) Foreign Application Priority Data

Mar. 11, 2019 (ZA) ..... 2019/01480

(51) Int. Cl.
*E04H 17/00* (2006.01)
*E04H 17/16* (2006.01)

(52) U.S. Cl.
CPC ..... *E04H 17/003* (2013.01); *E04H 17/161* (2013.01)

(58) Field of Classification Search
CPC ..... E04H 17/16; E04H 17/161; E04H 17/163; E04H 17/165; E04H 17/166; E04H 17/003
See application file for complete search history.

(56) References Cited

U.S. PATENT DOCUMENTS

| | | | | |
|---|---|---|---|---|
| D737,470 | S * | 8/2015 | Bucarizza | D25/119 |
| D737,472 | S * | 8/2015 | Bucarizza | D25/119 |
| 2007/0170411 | A1* | 7/2007 | Ribak | E04H 17/18 256/32 |
| 2018/0128010 | A1* | 5/2018 | Saltijeral | E04H 17/166 |

FOREIGN PATENT DOCUMENTS

| | | | | |
|---|---|---|---|---|
| CH | 683627 | A5 * | 4/1994 | E04H 17/161 |
| DE | 3412355 | A1 * | 10/1985 | E04H 17/04 |
| DE | 3710187 | A1 * | 10/1988 | E04H 17/161 |
| EP | 0098328 | A1 * | 1/1984 | E04H 17/161 |
| EP | 2065541 | A1 * | 6/2009 | E04H 17/06 |
| GB | 2167786 | A * | 6/1986 | E06B 11/02 |
| GB | 2252573 | A * | 8/1992 | E04H 17/003 |
| GB | 2493270 | A * | 1/2013 | E04H 17/003 |
| WO | WO-2008122059 | A2 * | 10/2008 | E04H 17/20 |

* cited by examiner

*Primary Examiner* — Jonathan P Masinick
(74) *Attorney, Agent, or Firm* — Tutunjian & Bitetto, P.C.

(57) ABSTRACT

A fence panel comprising a rectangular sheet of mesh material with opposed first and second edges, and opposed third and fourth edges, the sheet being formed with a plurality of spaced apart and parallel channel-shaped reinforcing formations, and a plurality of deterrent components each of which includes an elongate strip of projecting spikes fixed to at least one side of the mesh sheet.

8 Claims, 3 Drawing Sheets

FENCE PANEL

BACKGROUND OF THE INVENTION

This invention relates to a panel for use in the construction of a fence which has a significant deterrent value.

SUMMARY OF THE INVENTION

The invention provides a fence panel which includes a rectangular sheet of mesh material, the sheet including first and second opposed edges and third and fourth opposed edges and a plurality of deterrent components fixed to the sheet of mesh material between the first and second edges and the third and fourth edges.

The sheet of mesh material is preferably a high density mesh made from overlapping arrays of steel wires which are welded to one another at respective points of contact.

The sheet may be reinforced by means of elongate strips of flat bar or similar components which confer significant breach resistance to the sheet, and by means of stiffening formations which are fabricated by bending the sheet appropriately.

The stiffening formations may comprise a plurality of spaced apart and substantially parallel reinforcing formations. Each formation may comprise a channel which, in cross section, may be in the shape of a V or a U.

The sheet of material may lie substantially in a single plane and the deterrent components may include formations which project from the plane. The deterrent components may comprise spikes or the like. Preferably the deterrent components project from one side of the sheet i.e. out of the plane in which the sheet lies and from an opposing side of the sheet again out of the plane in which the sheet lies.

The reinforcing formations may extend from the third edge to the fourth edge and in use may be substantially horizontal. Preferably the deterrent components are fixed to the sheet of mesh material at least partly at locations which are at or close to each reinforcing formation.

BRIEF DESCRIPTION OF THE DRAWINGS

The invention is further described by way of examples with reference to the accompanying drawings in which.

DESCRIPTION OF PREFERRED EMBODIMENTS

Figure 1:
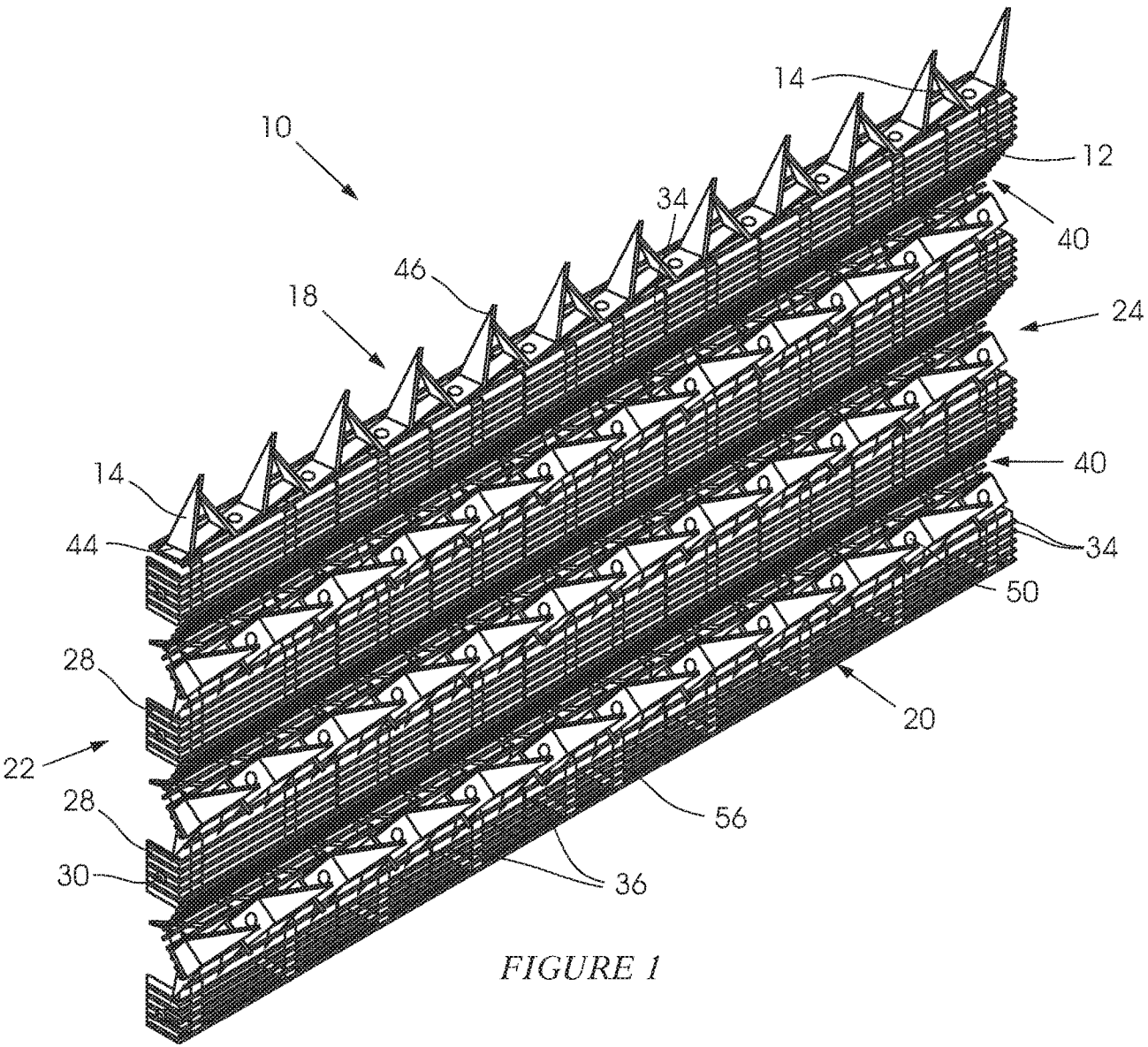
FIG. 1 is a perspective view from one side of a fence panel according to the invention.

FIG. 1 of the accompanying drawings illustrates a fence panel 10 according to one form of the invention.

The panel 10 includes a sheet 12 of mesh material and a plurality of deterrent components 14 which are fixed to the sheet 12 at spaced apart intervals.

The sheet 12 has a first edge 18 which in use extends horizontally and is uppermost, an opposing lower second edge 20, and third and fourth opposing edges 22 and 24 respectively which in use extend substantially vertically.

The sheet is rectangular in outline. In this specification "rectangular" includes "square".

At the third and fourth edges 22, 24 the sheet 12 has flanges 28 which enable the sheet to be fixed between spaced apart fence posts (not shown) which are erected using appropriate techniques to follow a barrier line. The flanges 28 are substantially at a right angle to a plane 32 (see FIG. 3A) in which the mesh sheet lies. The flanges 28 are bolted or fixed with appropriate fasteners 30 to the posts and the panel is then positioned between an adjacent pair of posts. The sheet 12 is formed from a first array of horizontally extending spaced apart wire rods 34 and a vertically extending array of spaced apart wire rods 36. The spacing between adjacent pairs of rods 34 is substantially less than the spacing between adjacent pairs of rods 36. The two arrays overlap one another and the rods 34 are welded to the rods 36 at respective points of contact.

Referring in addition to FIGS. 3A to 3F the sheet 12 is formed with a number of reinforcing formations 40. Each formation 40 is in the form of a channel which extends from the third edge 22 to the fourth edge 24, i.e. each channel formation is substantially horizontal, in use. Each channel has a V-shape and although this is preferred it is exemplary and non-limiting.

The deterrent components 14 comprise elongate metallic strips 44 which are formed with sharp protruding spikes 46. The strips 44 are fixed by means of fasteners 50, e.g. rivets, to successive sides 54 of the reinforcing formations 40. FIGS. 3A to 3F show different configurations of the deterrent components 14.

Figure 3A:
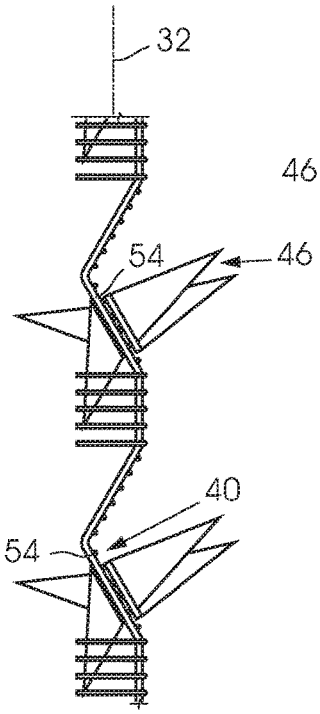
Figure 3B:
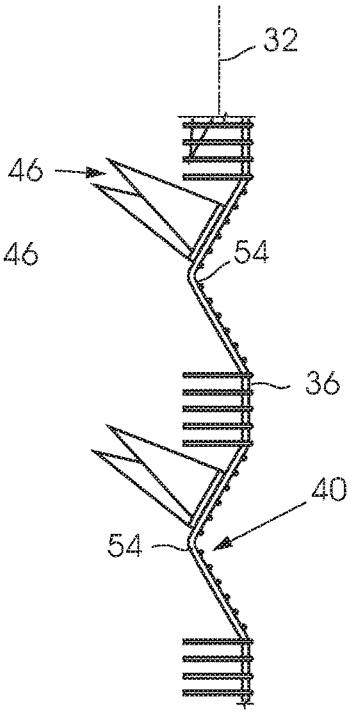
Figure 3C:
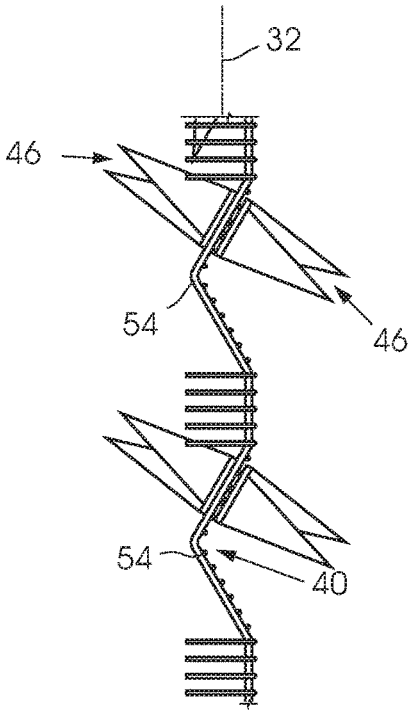

FIGS. 3A and 3C show that on one side of the sheet the spikes 46 project generally upwardly while on an opposing side of the mesh sheet the spikes project laterally and generally downwardly.

Figure 3D:
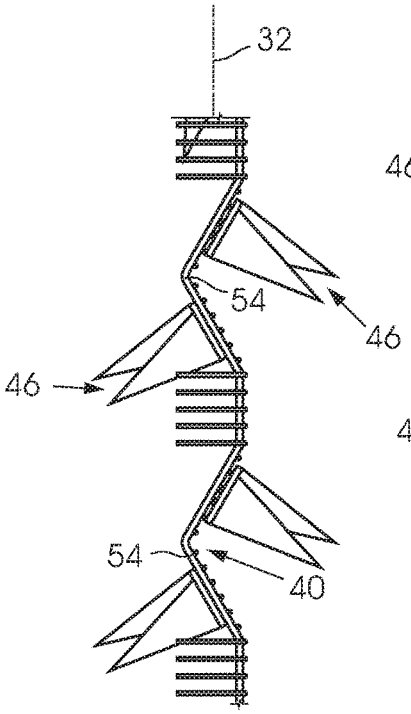
Figure 3E:
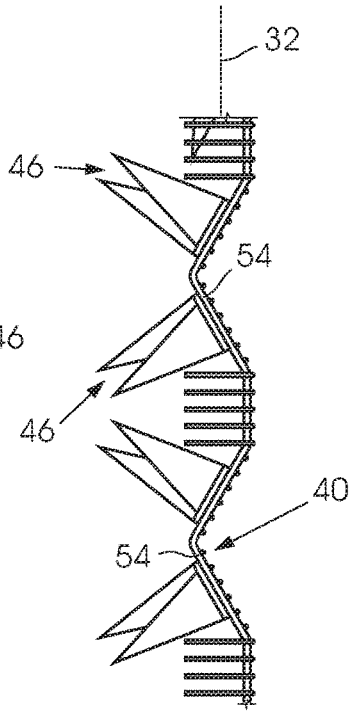
Figure 3F:
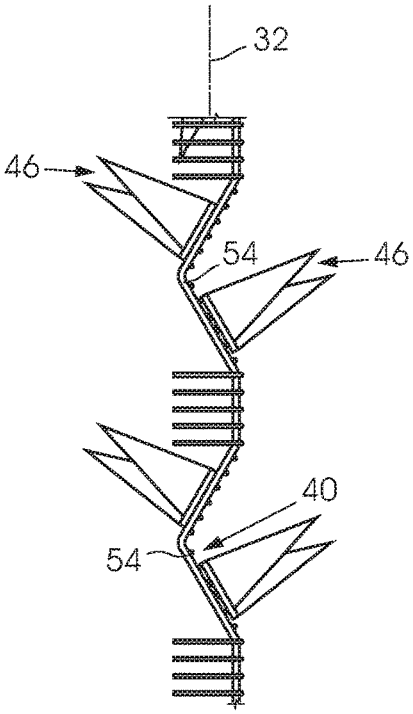

FIG. 3B shows an arrangement wherein the spikes 46 project generally upwardly on one side of the sheet 12. In FIG. 3D the spikes 46 project generally downwardly, on both sides of the sheet 12. In FIG. 3E on one side of the sheet 12, one set of spikes 46 projects generally upwardly and, a second set of spikes 46 projects generally downwardly. FIG. 3F is similar to FIG. 3D except that the spikes 46 project generally upwardly and not downwardly. Although these are preferred configurations, they are nonetheless exemplary and non-limiting.

If required vertically extending metallic strips 44 with protruding spikes 46 can be fixed to the posts to which the sheet are fixed. The spikes 46 on the posts provide an additional degree of deterrence.

When the mesh sheet 12 is formed, and prior to the reinforcing formations 40 being fashioned, the mesh sheet 12 is reinforced by means of parallel, spaced apart flat bars 56 which are welded to the mesh and which are positioned between successive adjacent pairs of vertically extending rods 36.

Given the significant barrier presented by the deterrent components 14 and the strong physical construction of the mesh sheet, stiffened by means of the reinforcing formations 40 and by means of the lengths of flat bar 56 the fence panel, once erected, offers substantial resistance to penetration. It is also difficult to climb over the fence. Under-digs in the ground, over which the fence panel is erected, can include mesh sections optionally embedded in concrete, to further enhance the deterrent effect of the erected barrier.

Figure 2:
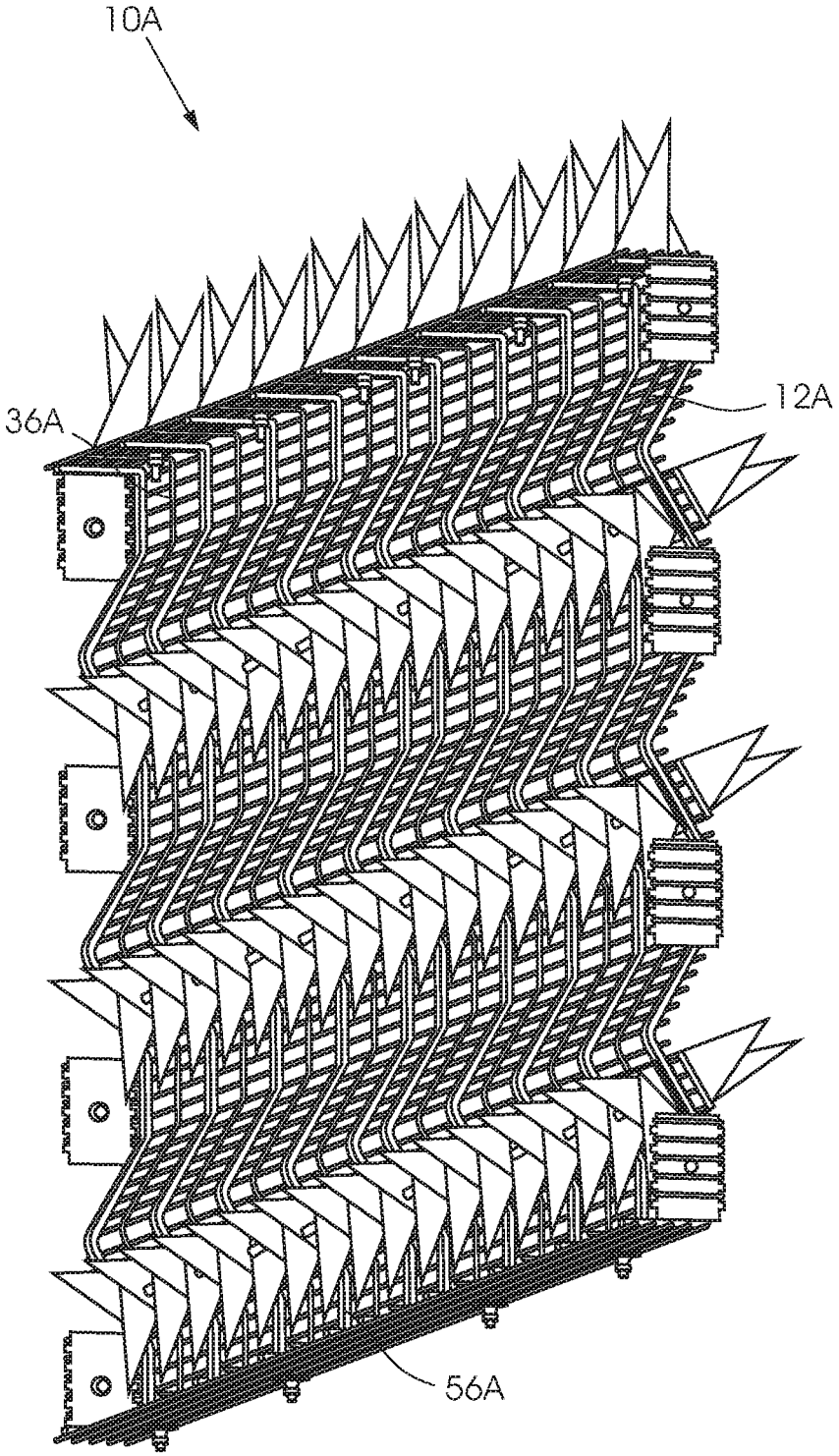
FIG. 2 illustrates a modified form of the fence panel shown in FIG. 1, and FIGS. 3A-3F are respective end views of a fence panel according to the invention showing various configurations of deterrent components.

FIG. 2 shows a fence panel 10A which in many respects is similar to the fence panel 10. However the mesh section 12A includes vertically extending rods 36A which are substantially closer to one another that what is the case for the mesh sheet 12. The sheet is reinforced by means of lengths of flat bar 56A which are present in a higher density than in the arrangement shown in FIG. 1. Thus, overall, the fence panel 10A is more robust than the panel 10.

The invention claimed is:

1. A fence panel comprising:

a rectangular sheet of mesh material, the sheet including first and second opposed horizontal edges, third and fourth opposed vertical edges, wherein the sheet is formed from a horizontally extending array of spaced apart wire rods and a vertically extending array of spaced apart wire rods, the rods in the respective arrays being welded to one another at respective points of contact;

a plurality of parallel reinforcing formations which are vertically spaced apart from one another and which extend horizontally from the third edge to the fourth edge; and a plurality of deterrent components including a plurality of elongate parallel metallic strips with protruding spikes, wherein the strips are vertically spaced apart from one another and are fixed at least to one side of the sheet of mesh material between the first and second edges and extend horizontally between the third and fourth edges.

2. The fence panel according to claim 1, wherein the sheet is reinforced by means of parallel spaced apart elongate strips of flat bars and each strip of flat bar positioned between a respective pair of adjacent rods in at least one of the arrays.

3. The fence panel according to claim 1, wherein each reinforcing formation is respectively in the form of a channel, and wherein the elongate metallic strips are respectively fixed to respective sides of the reinforcing formations.

4. The fence panel according to claim 3, wherein the sheet of mesh material at the third and fourth edges includes flanges which enable the sheet of mesh to be fixed to spaced apart fence posts.

5. The fence panel according to claim 1, wherein the deterrent components project from one side of the sheet and from an opposing side of the sheet.

6. The fence panel according to claim 1, wherein the protruding spikes of the deterrent components project generally upwardly, or generally downwardly relative to a plane in which the sheet of mess material lies.

7. A fence panel comprising:

a rectangular sheet of mesh material, the sheet including first and second opposed horizontal edges, third and fourth opposed vertical edges;

wherein the sheet is formed from a horizontally extending array of spaced apart wire rods and a vertically extending array of spaced apart wire rods and the rods in the respective arrays are welded to one another at respective points of contact, and wherein the sheet is reinforced by means of parallel spaced apart elongate strips of flat bars which are welded to the mesh and which are respectively positioned between adjacent pairs of adjacent rods in at least one of the arrays; and a plurality of deterrent components including a plurality of elongate parallel metallic strips with protruding spikes, wherein the strips are vertically spaced apart from one another and are fixed at least to one side of the sheet of mesh material between the first and second edges and extend horizontally between the third and fourth edges.

8. A fence panel comprising:

a rectangular sheet of mesh material, the sheet including first and second opposed horizontal edges, third and fourth opposed vertical edges;

wherein the sheet is formed from a horizontally extending array of spaced apart wire rods and a vertically extending array of spaced apart wire rods and the rods in the respective arrays are welded to one another at respective points of contact, and a plurality of deterrent components including a plurality of elongate parallel metallic strips with protruding spikes, wherein the strips are vertically spaced apart from one another and are fixed at least to one side of the sheet of mesh material between the first and second edges and extend horizontally between the third and fourth edges.

* * * * *